US008390196B2

(12) United States Patent
Van Der Eyden et al.

(10) Patent No.: US 8,390,196 B2
(45) Date of Patent: Mar. 5, 2013

(54) METHAL HALIDE LAMP COMPRISING A SHAPED CERAMIC DISCHARGE VESSEL

(75) Inventors: Josephus Theodorus Van Der Eyden, Eindhoven (NL); Oscar Gerard Stappers, Eindhoven (NL); Jacobus Johannes Franciscus Gerardus Heuts, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 120 days.

(21) Appl. No.: 12/595,653

(22) PCT Filed: Apr. 16, 2008

(86) PCT No.: PCT/IB2008/051454

§ 371 (c)(1), (2), (4) Date: Oct. 13, 2009

(87) PCT Pub. No.: WO2008/129466

PCT Pub. Date: Oct. 30, 2008

(65) Prior Publication Data

US 2010/0052532 A1 Mar. 4, 2010

(30) Foreign Application Priority Data

Apr. 20, 2007 (EP) ..... 07106599

(51) Int. Cl.
*H01J 17/16* (2012.01)

(52) U.S. Cl. ..... 313/634

(58) Field of Classification Search ..... 313/634
See application file for complete search history.

(56) References Cited

U.S. PATENT DOCUMENTS

| | | | | |
|---|---|---|---|---|
| 4,161,672 | A * | 7/1979 | Cap et al. | 313/620 |
| 5,220,244 | A * | 6/1993 | Maseki et al. | 313/620 |
| 5,239,230 | A | 8/1993 | Mathews et al. | |
| 5,936,351 | A | 8/1999 | Lang | |

FOREIGN PATENT DOCUMENTS

| | | | |
|---|---|---|---|
| DE | 20205707 | U1 | 7/2003 |
| EP | 0215524 | A1 | 3/1987 |
| EP | 0841687 | A2 | 5/1998 |
| EP | 1465239 | A2 | 10/2004 |
| EP | 1494261 | A2 | 1/2005 |
| JP | 2003007250 | A | 1/2003 |
| WO | 2005088675 | A1 | 9/2005 |
| WO | 2006046175 | A2 | 5/2006 |

* cited by examiner

*Primary Examiner* — Anh Mai
*Assistant Examiner* — Hana Featherly

(57) ABSTRACT

The invention provides a metal halide lamp having a ceramic discharge vessel, wherein the discharge vessel has a spheroid-like shape with a length L1 and a largest outer diameter d2, the discharge vessel further having curved extremities and openings at the curved extremities which have a curvature r3. The discharge vessel has an aspect ratio L1/d2 of 1.1?≦L1/d2?≦2.2 and a shape parameter r3/d2 of 0.7≦r3/d2≦1.1. This lamp has the advantage that it can be operated at a relatively high power. Furthermore, the lamp has a relatively high efficacy. Moreover, the lamp can be operated horizontally and vertically, i.e. it can be qualified for universal burning.

18 Claims, 4 Drawing Sheets

METHAL HALIDE LAMP COMPRISING A SHAPED CERAMIC DISCHARGE VESSEL

FIELD OF THE INVENTION

The present invention relates to a metal halide lamp comprising a ceramic discharge vessel, particularly a shaped ceramic discharge vessel.

BACKGROUND OF THE INVENTION

Metal halide lamps are known in the art and are described in, for instance, EP 0215524 and WO 2006/046175. Such lamps operate at high pressures and have burners or ceramic discharge vessels comprising ionizable gas fillings of, for instance, NaI (sodium iodide), TlI (thallium iodide), $CaI_2$ (calcium iodide) and/or $REI_n$. $REI_n$ refers to rare-earth iodides. Characteristic rare-earth iodides for metal halide lamps are $CeI_3$, $PrI_3$, $NdI_3$, $DyI_3$, and $LuI_3$.

Most present-day discharge vessels for metal halide lamps have a spherical shape, as described in, for instance, DE 20205707, a cylindrical shape, as described in, for instance, EP 0215524 or WO 2006/046175, or an extended spherical shape as described in, for instance, EP 0841687 (U.S. Pat. No. 5,936,351). The latter document describes a ceramic discharge vessel for a high-pressure discharge lamp constituted by a cylindrical central part and two hemispherical end pieces, wherein the length of the central part is smaller than or equal to the radius of the end pieces. In this way, the isothermy of the discharge vessel is improved.

SUMMARY OF THE INVENTION

These prior-art metal halide lamps or ceramic discharge metal halide lamps (CDM lamps) have one or more of the drawbacks that their lumen maintenance is less than would be desired. Another drawback may be that the combination of a high color rendering, indicated by means of the commonly used general color-rendering index Ra, also known as CRI, with values of about 90 or more, and a high efficacy, such as about 110 lm/W or more, does not seem to be easily possible. Color rendering for nine standard colors, particularly important for the red part of the color spectrum and indicated by R9, is generally very poor at very low values, which can even be negative. Particularly when they are operated at a relatively high power of about 150 W or more, such prior-art lamps sometimes have the further drawback that they are not qualified for universal burning, i.e. burning in a universal position, and can therefore be operated, for instance, only in a vertical arrangement of the burner (discharge vessel) in order to prevent cracks in the burner or its protruding end plugs, which may result in explosion of the burner.

It is an object of the invention to provide an alternative metal halide lamp which preferably further obviates one or more of the drawbacks described above.

To this end, the invention provides a metal halide lamp comprising a ceramic discharge vessel, wherein the discharge vessel has a wall enclosing a discharge space with an ionizable filling, the discharge space further enclosing electrodes having electrode tips arranged opposite each other and arranged to define a discharge arc between the electrode tips during operation of the lamp, the discharge vessel having a spheroid-like shape with a major axis and a length L1 (outer length), a largest inner diameter d1 and a largest outer diameter d2 and further having curved extremities with a curvature with radius r3, wherein an aspect ratio L1/d2 is $1.1 \leqq L1/d2 \leqq 2.2$ and a first shape parameter r3/d2 is $0.7 \leqq r3/d2 \leqq 1.1$.

This lamp has the advantage that it can be operated at a relatively high power, e.g. at more than about 150 W. Furthermore, the lamp has a relatively high efficacy; efficacies of over 115 lm/W are possible at these high power values. Moreover, the lamp can be operated horizontally and vertically, i.e. it can be qualified for universal burning. It also appears that the lamp is less apt to forming cracks in the discharge vessel during its lifetime as compared with state-of-the-art lamps. For instance, when a lamp having a shape parameter of 0.5 is used (which is outside the claimed range), cracks are often observed in the wall of the discharge vessel at high power values. Likewise, discharge vessels of lamps having a large shape parameter often show cracks. However, the discharge vessel of the lamp according to the invention has a shape that provides stability while allowing a high power during operation of the lamp, as well as a high efficacy and universal burning.

In a preferred embodiment, the electrode tips are arranged at a distance L3 of each other, and a second space parameter, L3/L1, is in the range of $0.4 \leqq L3/L1 \leqq 0.7$. Within this range, stable discharge vessel (operation) is found, whereas the formation of cracks increases outside this range.

In a specific embodiment, the discharge vessel further comprises protruding end plugs which surround at least part of the electrodes.

In a preferred embodiment, the ionizable filling comprises NaI, TlI, $CaI_2$ and X-iodide, wherein X is one or more elements selected from the group comprising rare-earth metals, scandium and yttrium. Particularly lamps having such fillings according to the invention show good optical properties and maintenance. In yet another preferred embodiment, the filling of the discharge space also comprises one or more halides selected from Mn and In, which is especially useful for obtaining lamps with a high correlated color temperature (CCT). Hence, in an embodiment, the ionizable filling further comprises one or more halides selected from the group consisting of Mn and In, especially Mn and/or In iodides.

BRIEF DESCRIPTION OF THE DRAWINGS

Embodiments of the invention will now be described, by way of example only, with reference to the accompanying schematic drawings in which corresponding reference symbols indicate corresponding parts.

DESCRIPTION OF EMBODIMENTS

General Description of the Lamp

Figure 1:
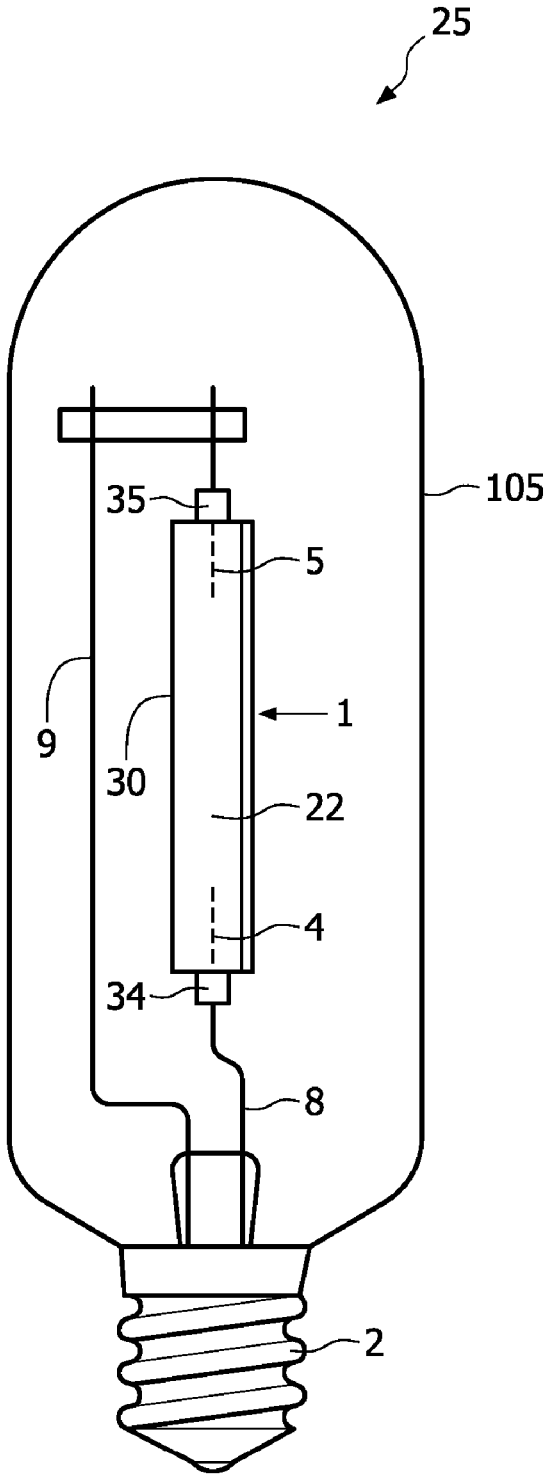
FIG. 1 schematically depicts a general embodiment of the lamp according to the invention in a side elevation, without details of the discharge vessel.

Metal halide lamps or ceramic discharge metal (CDM) halide lamps are generally known. An embodiment of such a metal halide lamp is schematically depicted in FIG. 1. In general, metal halide lamps, here denoted by reference numeral 25, comprise a discharge vessel 1 surrounded with clearance by an outer envelope 105 and having a ceramic wall or vessel wall 30 (with an internal surface 12 and an external surface 13, see FIG. 2) which encloses a discharge space 22 having a filling comprising an inert gas, such as xenon (Xe) or argon (Ar), and an ionizable salt, and with two electrodes 4 and 5 arranged in said discharge space 22. The discharge vessel 1 is surrounded by an outer bulb or an outer envelope 105 which is provided with a lamp cap 2 at one end. The outer envelope 105 may be vacuum or filled with an inert gas such as nitrogen. In operation, a discharge extends between the electrodes 4 and 5. The electrode 4 is connected to a first electric contact forming part of the lamp cap 2 via a current lead-through conductor 8. The electrode 5 is connected to a second electric contact forming part of the lamp cap 2 via a current lead-through conductor 9.

In the schematic FIGS. 1 to 4, the discharge vessel 1 further comprises protruding end plugs 34,35, each at one side and each arranged to enclose at least part of the electrodes 4,5, respectively. However, the invention is also applicable to discharge vessels 1 which do not comprise such protruding end plugs 34,35 (see also below).

In this description and claims, the ceramic wall 30 is understood to mean both a wall of metal oxide such as, for instance, sapphire or densely sintered polycrystalline $Al_2O_3$ and metal nitride, for instance, AlN. According to the state of the art, these ceramics are well suited to form translucent discharge vessel walls 30.

Figure 2:
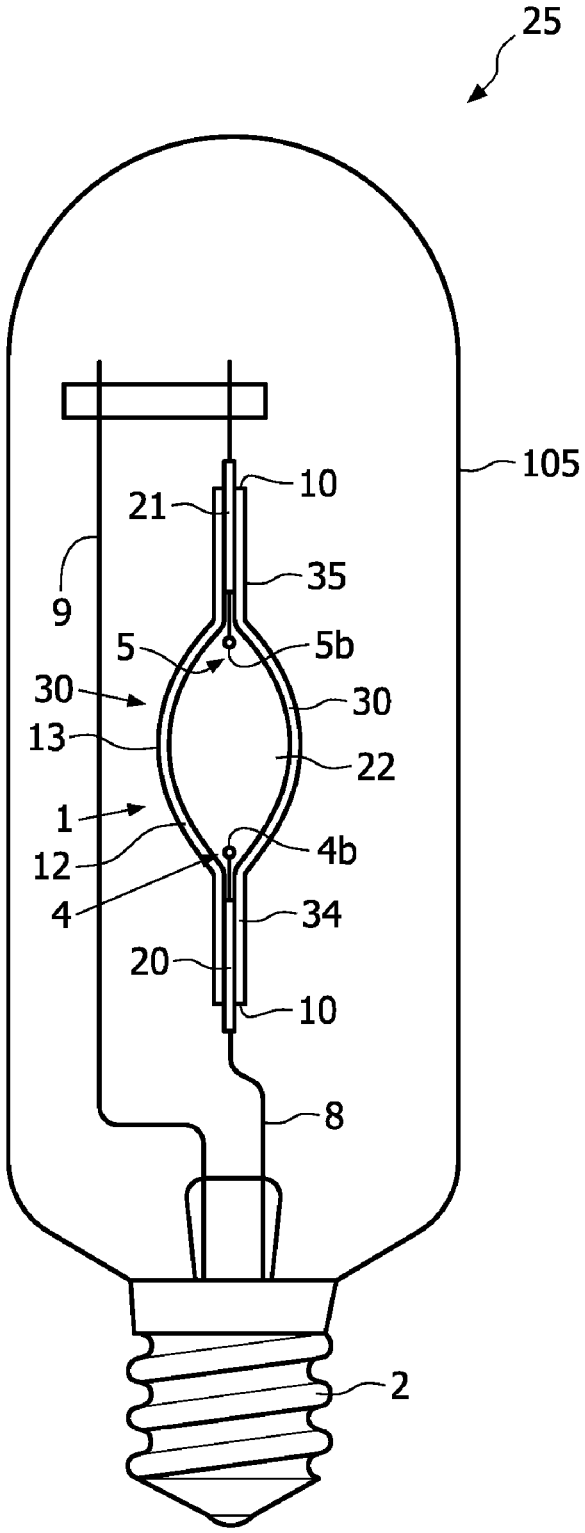
FIG. 2 schematically depicts a general embodiment of the lamp according to the invention in a side elevation, with a shaped discharge vessel (not drawn to scale) as described herein.

FIG. 2 shows a preferred embodiment of the lamp in more detail. A shaped discharge vessel 1 is schematically depicted. The lamp shown is not drawn to true scale. FIG. 2 shows that the electrodes have electrode tips 4*b*,5*b* having a mutual interspacing so as to define a discharge path between them during operation of the lamp. In the embodiment, each electrode 4,5 is supported by a current lead-through conductor 20,21 entering the discharge vessel 1. The current lead-through conductors 20,21 preferably consist of a first part made of a halide-resistant material such as, for instance, a Mo—$Al_2O_3$ cermet, and a second part made of, for instance, niobium. Niobium is chosen because this material has a coefficient of thermal expansion corresponding to that of the discharge vessel 1 and prevents leakage from the lamp 25. Other possible constructions are known, for instance, from EP0587238 (herein incorporated by reference, wherein a Mo coil-to-rod configuration is described). The current lead-through conductors may be sealed into the protruding end plugs 34,35 with seals 10.

General Description of the Ionizable Filling

The ionizable filling generally comprises a salt (including a mixture of salts). The ionizable filling used in the invention preferably comprises one or more components selected from the group comprising iodides of Li, Na, K, Rb, Cs, Mg, Ca, Sr, Ba, Sc, Y, La, Ce, Pr, Nd, Sm, Eu, Gd, Tb, Dy, Ho, Er, Tm, Yb, Lu, In, Tl, Sn, Mn, and Zn, particularly one or more components selected from the group comprising LiI, NaI, KI, RbI, CsI, $MgI_2$, $CaI_2$, $SrI_2$, $BaI_2$, $ScI_3$, $YI_3$, $LaI_3$, $CeI_3$, $PrI_3$, $NdI_3$, $SmI_2$, $EUI_2$, $GdI_3$, $TbI_3$, $DyI_3$, $HoI_3$, $ErI_3$, $TmI_3$, $YbI_2$, $LuI_3$, InI, TlI, $SnI_2$, $MnI_2$, and $ZnI_2$. Furthermore, the discharge space 22 generally contains Hg (mercury) and a starter gas such as Ar (argon) or Xe (xenon), as known in the art. In a preferred embodiment of a lamp according to the invention, the discharge vessel 1 further contains mercury (Hg). In an alternative embodiment, the discharge vessel 1 is free from mercury, i.e. the filling quantities do not take the quantity of mercury that is present into account. Mercury is dosed to the discharge vessel 1 in quantities known to the person skilled in the art.

The ionizable filling preferably comprises NaI, TlI, $CaI_2$, and X-iodide, wherein X is one or more elements selected from the group comprising rare-earth metals, yttrium and scandium. X can thus be formed by a single element or by a mixture of two or more elements. For the sake of simplicity, the terms "rare earth" and "X" include Sc and Y.

X is preferably selected from the group comprising Sc, Y, La, Ce, Pr, Gd, Tb, Dy, Ho, Er, Tm, Yb, Lu, and Nd. More preferably, X is selected from the group comprising Ce, Pr, and Nd. In one embodiment, X is Dy. In another embodiment, X is Ce. The elements Sc, Y, La, Ce, Pr, Nd, Gd, Tb, Dy, Ho, Er, Tm, Yb, Lu, Na, Tl, Ca, and I stand for scandium, yttrium, lanthanum, cerium, praseodymium, neodymium, gadolinium, terbium, dysprosium, holmium, erbium, thulium, ytterbium, lutetium, sodium, thallium, calcium, and iodine, respectively. Hence, X-iodide may also include a plurality of different iodides. In a further embodiment, the ionizable filling further comprises halides, particularly iodides, of manganese and/or indium (see also below).

In a preferred embodiment of the lamp 25 according to the invention, X is the total quantity of rare earth, and the molar percentage ratio X-iodide/(NaI+TlI+$CaI_2$+X-iodide (+optionally $MnI_2$ and/or InI)) is above 0% up to maximally 10%, particularly in the range of 0.5 to 7%, more particularly in the range of 1 to 6%. At a too low quantity of X, experiments have proved that the electrodes may reach too high temperature values to operate satisfactorily. At quantities of X above the indicated maximum, it becomes more difficult to maintain a W-halide cycle in the discharge vessel 1 during lamp operation.

With X being the total quantity of rare earth (including Sc and Y), the molar percentage ratio $CaI_2$/(NaI+TlL+$CaI_2$+X-iodide (+optionally $MnI_2$ and/or InI)) is preferably in the range of 10 to 95%. In another preferred embodiment of a lamp according to the invention, the quantity of NaI, TlL, $CaI_2$ and X-iodide (+optionally $MnI_2$ and/or InI) is in the range of 0.001 to 0.5 g/$cm^3$, particularly in the range of 0.005 to 0.3 g/$cm^3$. The volume of the discharge vessel particularly ranges between 1.0 and 10.0 $cm^3$, depending on the lamp power. Characteristic quantities of ionizable gas fillings are salt doses of about 5 to 50 mg.

To have a lamp which emits light at a color temperature (CCT) above 3500 K during its stable nominal operation, the filling of a preferred embodiment of the lamp according to the invention also comprises one or more halides selected from Mn and In. With the addition of a halide of Mn and/or In, the color point of the light emitted by the lamp can be adjusted primarily along the x-axis of the CIE color triangle having x,y-coordinates.

Varying the quantity of Tl halide in the filling has a major impact on the adjustment of the color point along the y-axis. In this respect, stable nominal operation is understood to mean that the lamp 25 is operated at a power and voltage for which it is designed. The designed power of the lamp 25 is referred to as the nominal or rated power. Wall load as herein defined is the lamp power divided by the surface of the external wall 13 excluding the optional protruding end plugs 34,35. Characteristic wall loads of the wall of the discharge vessel on the surface 13 of the lamp 25 of the invention are in the range of about 18 to 30 W/$cm^2$, particularly in the range of about 20 to 28 W/$cm^2$. Loads on the surface 12 of the internal wall are generally in the range of about 25 to 35 W/$cm^2$.

Preferred fillings are described in WO2005/088675, which is herein incorporated by reference.

Shaped Discharge Vessel

Figure 3:
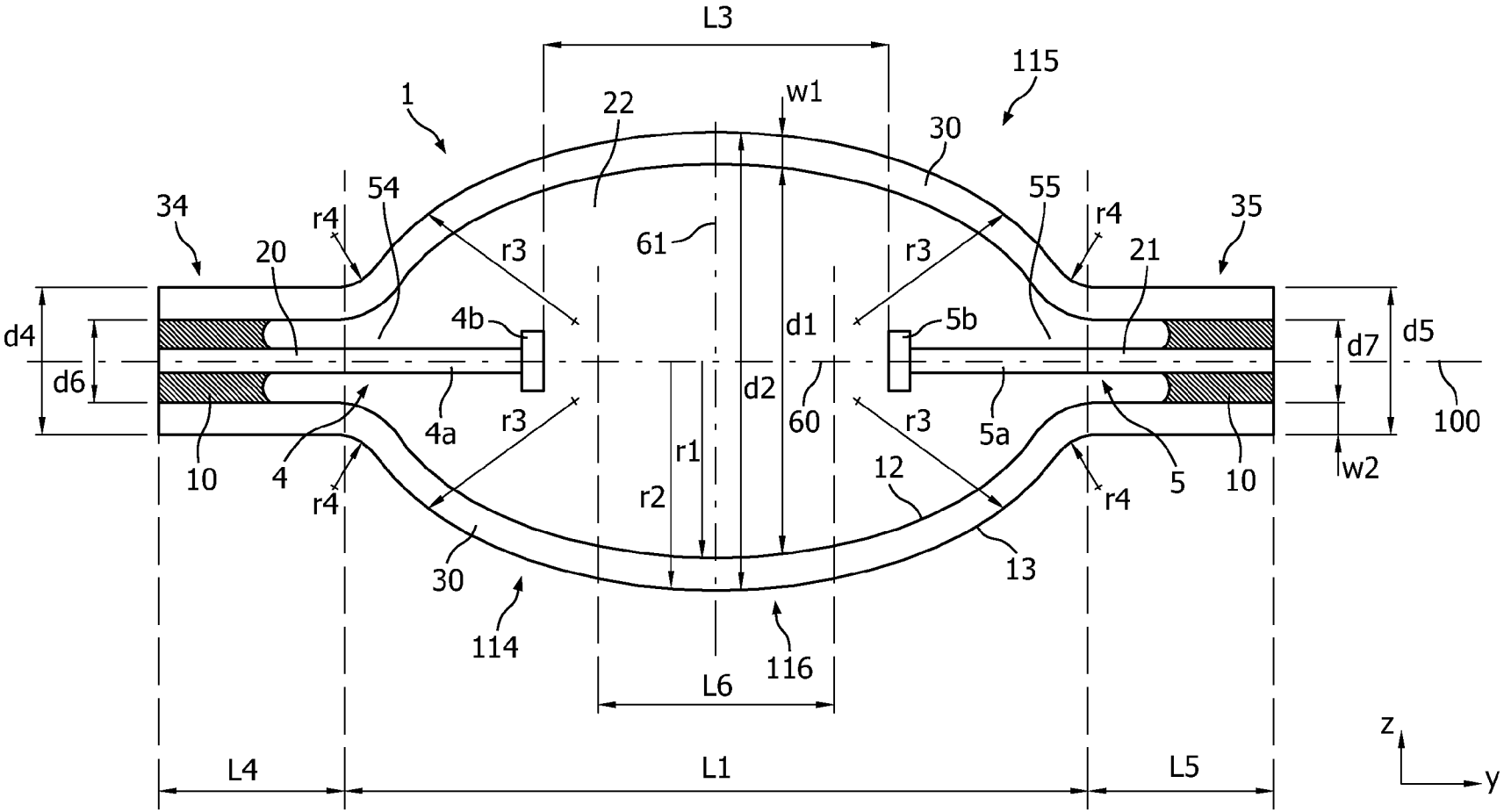
FIG. 3. schematically shows in more detail the shaped discharge vessel of the lamp in accordance with an embodiment of the invention (not drawn to scale)

The discharge vessel of the lamp 25 of the invention will now be described in detail. A preferred embodiment, including optional features such as the protruding end plugs 34,35, is schematically depicted in FIG. 3 (not drawn to scale). FIG. 3 shows an embodiment of the discharge vessel 1 of a metal halide lamp 25 having a ceramic wall 30 which encloses a discharge space 22 containing an ionizable filling. Two, for instance, tungsten electrodes 4,5 with tips 4*b*, 5*b* at a mutual distance L3 are located in the discharge vessel 1. In this schematically depicted embodiment, the discharge vessel 1 is closed by means of ceramic protruding end plugs 34,35 and encloses current lead-through conductors 20,21 connected to electrodes 4,5 positioned in the discharge vessel 1 with a narrow intervening space, and is connected to these conductors 20,21 in a gastight manner by means of a melting-ceramic joint or sealing 10 at ends remote from the discharge space 22 (see also above). However, the invention is not limited to the embodiment depicted in FIG. 3, see, for instance, also FIG. 4. The description of the discharge vessel 1 below first concentrates on the general aspects of the shaped discharge vessel 1 of the lamp 25 of the invention, and then deals with some preferred embodiments.

The discharge vessel 1 has a wall 30 enclosing the discharge space 22 with the ionizable filling. The discharge space encloses electrodes 4,5 with electrode tips 4*b*,5*b*.

The discharge vessel 1 has a spheroid-like shape with a major axis 60 and an outer length L1, a largest inner diameter d1 and a largest outer diameter d2. Furthermore, the discharge vessel 1 has curved extremities 114,115 and openings 54,55 at (or in) the curved extremities 114,115. These openings 54,55 are arranged to surround the electrodes 4,5. The curved extremities 114,115 have a curvature with radius r3. The shaped discharge vessel 1 of the lamp of the invention is defined by an aspect ratio AR=L1/d2 and a first shape parameter SP=r3/d2.

Spheroids are known in the art and are obtained by rotating an ellipse about one of its major axes. The discharge vessel 1 of the invention has a spheroid-like shape, more particularly a prolate spheroid-like shape (i.e. a shape like a rugby ball). A prolate spheroid has a major axis, here denoted by reference numeral 60, and a minor axis, here denoted by reference numeral 61; the major axis 60 is larger than the minor axis 61.

Figure 4:
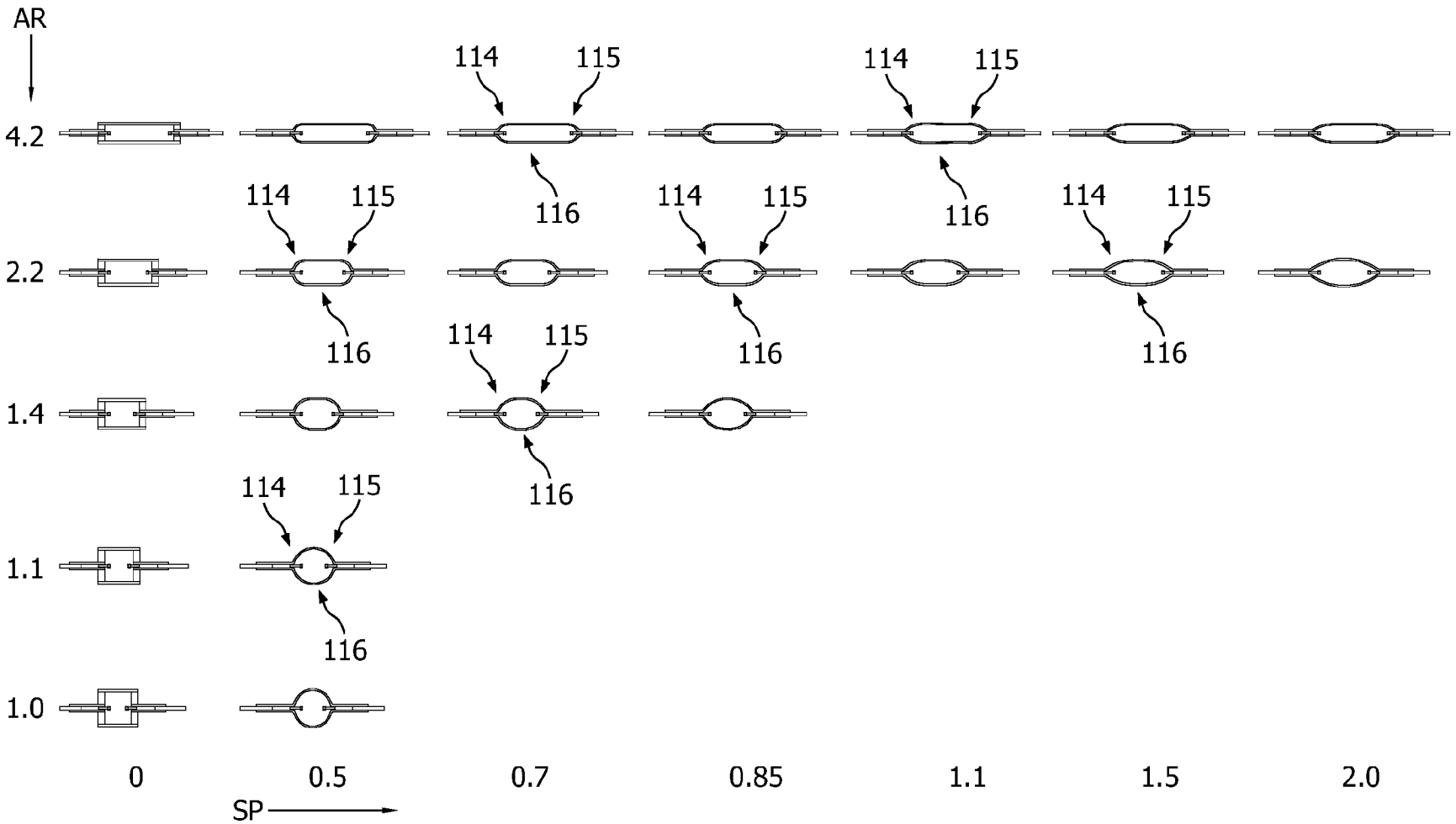
FIG. 4 schematically depicts a plurality of shaped discharge vessels as a function of the aspect ratio and shape parameter (not drawn to scale).

FIG. 4 schematically depicts a plurality of possible discharge vessel constructions, both within and outside the aspect ratio and shape parameter values as described herein. The term "spheroid-like shape" is used because the discharge vessel 1 of the lamp 25 of the invention may have shapes close to spherical at low aspect ratios AR and small values of the first shape parameter SP. At intermediate aspect ratios and first shape parameter values, the discharge vessel 1 substantially has a spheroid shape. When the aspect ratio AR further increases, particularly to above about 1.5, the discharge vessel 1 can be characterized by a spheroid having a central cylindrical part. In FIG. 4, this is indicated by a cylindrical intermediate part 116 which may (substantially) be absent at low aspect ratios and low shape parameters but is particularly present at relatively high aspect ratios. Hence, the discharge vessel of the lamp of the invention has shapes varying from close to spherical shapes to cigar-like shapes. These shapes are herein indicated as "spheroid-like shapes".

Since the discharge vessel 1 has a spheroid-like shape, this also implies that a discharge vessel 1 having a shape close to spherical has a radius r3 that is substantially constant over the curved extremities 114,115. However, when the discharge vessel 1 has a shape deviating from close to spherical and a shape that is more like a spheroid, the radius r3 may vary over the curved extremities 114,115 in some embodiments. Radius r3 may therefore also be indicated as mean radius r3. As will be clear to the person skilled in the art, the mean curvature 1/r3 can then be derived by integrating the local curvature along the contour of the curved part and dividing by the length of the contour along which the curvature is integrated.

The discharge vessel 1 of the lamp 25 of the invention is substantially symmetrical around major axis 60. For the sake of clarity, a coordinate system is drawn in FIG. 3, wherein the major axis 60 extends along the y axis and the minor axis 61 extends along the z axis, perpendicular to the y axis. The discharge vessel 1 is essentially rotationally symmetric around major axis 60. Furthermore, a longitudinal axis 100 through the discharge vessel 1 is drawn. Major axis 60 coincides with part of this longitudinal axis. The optional protruding end plugs 34 and 35 (see above and below) are also rotationally symmetric around the longitudinal axis 100 of the discharge vessel (and thus in fact also around major axis 60).

The discharge vessel has a largest internal radius r1, i.e. the length of a perpendicular from major axis 60 to the internal surface 12 of vessel wall 30, and a largest external radius r2, i.e. the length of a perpendicular from major axis 60 to the external surface 13 of vessel wall 30. Hence, the discharge vessel 1 has a wall thickness w1 which is equal to r2-r1. The thickness w1 is preferably substantially equal throughout the wall 30 of the discharge vessel. The discharge vessel 1 preferably has a wall thickness w1 in the range of 0.5 to 2 mm, more preferably from about 0.8 to 1.2 mm. As indicated in FIG. 3, the discharge vessel 1 also has a largest inner diameter d1, i.e. the largest diameter of the vessel from internal surface 12 to an opposite internal surface measured along a perpendicular to major axis 60. This inner diameter d1 is equal to the length of the minor axis 61 within the discharge vessel 1. Furthermore, the discharge vessel 1 has a maximum outer diameter d2. The outer diameter d2 is equal to the length of the minor axis 61. As will be clear to the person skilled in the art, (d1+d2)/2=w1.

The part or region of the discharge vessel 1 with the largest diameter d2 is indicated as intermediate region 116. In fact, the discharge vessel 1 of the invention can be considered as two curved parts or curved extremities 114,115 between which an intermediate region 116 is found which may be, for instance, cylindrical. These regions or parts 114, 115 and 116 are only indicated for the sake of simplicity.

The extremities 114 and 115 of the discharge vessel 1 are curved. Note that, in the Figures, protruding end plugs 34 and 35 are connected to these extremities. The protruding end plugs are optional and will be described below. These curved extremities have a certain curvature (or mean curvature) with radius r3 (see above). Since the discharge vessel is rotationally symmetric around its major axis 60 and preferably also symmetric around its minor axis 61, the curvature of these curved extremities 114,115 is the same at each side from an intersection (vertex) of major axis 60 and minor axis 61. The vessel 1 is characterized by AR=L1/d2 which is $1.1 \leqq L1/d2 \leqq 2.2$ and the first shape parameter SP=r3/d2 which is $0.7 \leqq r3/d2 \leqq 1.1$.

The curved extremities 114 and 115 have openings 54 and 55 which are arranged to enclose or surround the electrodes 4 and 5 at least partially. Note that the electrodes 4,5, or more precisely the current lead-through conductors 20,21, may be directly sintered to the wall 30 of the discharge vessel, but may also be partially integrated into the protruding end plugs 34,35. Furthermore, the current lead-through conductors 20,21 may also be directly sintered into the protruding end plugs 34,35, respectively, or sealed into the protruding end plugs 34,35 with seals 10. Anyhow, the current lead-through conductors 20,21 are arranged in discharge vessel 1 in a vacuumtight manner.

The electrodes 4,5 enter the discharge vessel 1 via openings 54 and 55 which surround at least part of the electrodes. The mutual distance between the openings 54,55, or the distance from one side of the major axis 60 to the other side of the major axis 60 is indicated as length L1 (or outer length L1) of the discharge vessel 1. Hence, length L1 is equal to the length of the major axis 60 and diameter d2 is equal to the length of the minor axis 61. The electrodes 4,5 have electrode tips 4*b* and 5*b* which are arranged at a mutual distance L3. This distance is often also indicated as ED or EA. Note that the electrodes 4,5 are located in the discharge vessel 1 along major axis 60.

The invention thus provides a metal halide lamp 25 comprising a ceramic discharge vessel 1 which has a wall 30 enclosing a discharge space 22 with an ionizable filling, the discharge space 22 further enclosing electrodes 4,5 having electrode tips 4*b*,5*b* arranged opposite each other and arranged to define a discharge arc between the electrode tips 4*b*,5*b* during operation of the lamp 25, the discharge vessel 1 having a spheroid-like shape with a major axis 60 and a length L1, a largest inner diameter d1 and a largest outer diameter d2 and further having curved extremities 114,115 and openings 54,55 at the curved extremities 114,115, which openings 54,55 are arranged to surround the electrodes 4,5 or the current lead-through conductors 20,21, and the curved extremities 114,115 have a curvature r3, wherein the aspect ratio AR=L1/d2 is $1.1 \leqq L1/d2 \leqq 2.2$ and the first shape parameter SP=r3/d2 is $0.7 \leqq r3/d2 \leqq 1.1$.

As regards aspect ratio AR and first shape parameter SP, and particularly when using the preferred ionizable fillings as described above (i.e. NaI, T11, $CaI_2$ and X-iodide and optionally $MnI_2$ and/or InI), it appears that lamps 25 used under these shape conditions have excellent optical properties, maintenance, efficacy and universal burning.

At larger or smaller values of the first shape parameter SP and aspect ratio AR, cracks are often found, leading to failure of the lamp. A relatively low efficacy is found in some cases in which an aspect ratio AR close to about 1.0 is used. In other cases, in which a shape parameter SP of, for instance, 0.5 is used, cracks are often observed in the wall of the discharge vessel, particularly at high power values. The efficacy is reduced at lower values of L1/d2. The risk of failure increases at higher values of L1/d2. If the shape parameter r3/d2 is too low or too high, the risk of failure will also increase. Hence, it appears that, particularly under the conditions of the discharge vessel 1 as defined above, the lamp 25 of the invention has the advantages of a high efficacy, good maintenance in a universal burning position and good optical properties (relatively high values for CRI (color rendering), R9 and color temperature CCT) and a long lifetime. Efficacies of at least 110 lm/W during operation (stable operation at rated power) and even efficacies of at least 115 lm/W (stable operation at rated power) can be obtained for the lamp 25 of the invention.

Lamps 25 with a first shape parameter of $0.75 \leqq r3/d2 \leqq 0.9$ and/or an aspect ratio of $1.3 \leqq L1/d2 \leqq 1.7$ are particularly advantageous in terms of efficacy, color rendering and a long lifetime.

Lamps can be made with a nominal power of any suitable value ranging from about 20 W to about 1000 W or more. The lamp is preferably made with wattages of more than 100 W, preferably more than 150 W (even up to or more than 1000 W) that qualify for a universal burning position. Hence, the rated power of the lamp 25 may be larger than 100 W, preferably of the order of about 150 W or more, preferably in the range of 150 W to 1000 W, although larger power values are also possible. Characteristic wattages are, for instance, 150 W, 210 W, 315 W, 400 W, 600 W, and 1000 W.

Moreover, it appears that the ratio of the distance L3 between the electrode tips 4*b*,5*b* and the length L1 of the discharge vessel 1 is advantageously in the range of 0.4 to 0.7. In this way, the distance of the electrode (tips) to the wall 30 of the discharge vessel, i.e. particularly its internal surface 12, is sufficient so that crack formation is prevented or reduced. Hence, the ratio L3/L1, indicated as second space parameter SPP, is preferably $0.4 \leqq L3/L1 \leqq 0.7$. If the second space parameter SPP=L3/L1 is smaller than about 0.4, the lamp efficacy will become too low, and if the second space parameter is above 0.7, the electrode tips 4*b*,5*b* may come too close to the wall 30, which leads to cracking of the discharge vessel 1.

In a specific variant, which is preferably applied, the discharge vessel 1 further comprises protruding end plugs 34,35, as schematically depicted in FIGS. 2 to 4. Together with the wall 30 of the discharge vessel, these protruding end plugs 34,35 may constitute one body. The protruding end plugs 34,35 are rotationally symmetric around a longitudinal axis 100 and are arranged to enclose the current lead-through conductors 20 and 21, respectively. The conductors 20,21, may be sealed into the protruding end plugs 34,35 by means of seal 10 or may directly be sealed into the plugs 34,35 without using a separate sealing material to form seal 10. The protruding end plugs have an inner diameter d6, d7 and an outer diameter d4,d5, respectively. Furthermore, the protruding end plugs 34,35 have a wall width w2 which is preferably substantially equal to wall width w1 of the wall 30 of the ceramic discharge vessel. The plugs 34,35 have a length L4,L5, respectively, which are preferably substantially equal. Hence, in one embodiment, the openings 54,55 at the curved extremities 114,115 may be arranged to surround the electrodes 4,5 (particularly when no protruding end plugs 34,35 are used) and, in another embodiment, they may be arranged to surround the current lead-through conductors 20,21.

At the end of the extremities 114,115, the wall 30 of discharge vessel 1 may have a further curvature which is different from the curvature with radius r3, in the direction of the protruding end plugs 34,35. This curvature is indicated as radius r4. This curved part is generally only a minor part of the curved extremities 114,115. The curvature radius r4 is generally of the order of about 0.5 to 3.0 mm, preferably 1.0 to 2.0 mm.

The invention also relates to a metal halide lamp 25 to be used in a vehicle headlamp and to a headlamp comprising the lamp 25 according to the invention.

Examples

A large number of experimental lamps were made. Some examples and comparative examples with discharge vessels 1 described herein and fulfilling the criteria described above, as well as discharge vessels having aspect ratios and shape parameters outside these criteria were made and measured. An overview is given of the lamps that were made, with discharge vessel dimensions in Table 1, fillings according to Table 2 and results given in Table 3.

TABLE 1

Design of discharge vessels (burners) of experimental lamps

| Lamp | AR = L1/d2 | SP = r3/d2 | SPP = L3/L1 | d1 mm | L1 mm | r3 mm | r4 mm | d2 mm | w1 mm | L4, L5 mm | d4, d5 mm | d6, d7 mm | L3 mm |
|---|---|---|---|---|---|---|---|---|---|---|---|---|---|
| 1 | 1.41 | 0.83 | 0.62 | 16.4 | 26.0 | 15.3 | 2.0 | 18.4 | 1.0 | 17.8 | 4.0 | 1.6 | 16.0 |
| 2 | 1.41 | 0.83 | 0.62 | 16.4 | 26.0 | 15.3 | 2.0 | 18.4 | 1.0 | 17.8 | 4.0 | 1.6 | 16.0 |
| 3 | 1.41 | 0.83 | 0.62 | 16.4 | 26.0 | 15.3 | 2.0 | 18.4 | 1.0 | 17.8 | 4.0 | 1.6 | 16.0 |
| 4 | 1.43 | 0.83 | 0.52 | 13.3 | 21.3 | 12.3 | 2.0 | 14.9 | 0.8 | 18.0 | 2.6 | 1.0 | 11.0 |
| 5 | 1.43 | 0.83 | 0.52 | 13.3 | 21.3 | 12.3 | 2.0 | 14.9 | 0.8 | 18.0 | 2.6 | 1.0 | 11.0 |
| 6 | 1.42 | 0.83 | 0.57 | 10.8 | 17.6 | 10.3 | 1.5 | 12.4 | 0.8 | 16.0 | 2.6 | 1.0 | 10.0 |
| 7 | 1.42 | 0.83 | 0.57 | 10.8 | 17.6 | 10.3 | 1.5 | 12.4 | 0.8 | 16.0 | 2.6 | 1.0 | 10.0 |
| 8 | 2.26 | 0.50 | 0.75 | 11.7 | 31.0 | 6.9 | 2.0 | 13.7 | 1.0 | 17.8 | 4.0 | 1.6 | 23.1 |
| 9 | 1.45 | 0.50 | 0.66 | 15.0 | 24.6 | 8.5 | 2.0 | 17.0 | 1.0 | 17.8 | 4.0 | 1.6 | 16.2 |
| 10 | 1.05 | 0.50 | 0.59 | 18.0 | 20.9 | 10.0 | 2.0 | 20.0 | 1.0 | 17.8 | 4.0 | 1.6 | 12.4 |
| 11 | 1.43 | 0.83 | 0.56 | 13.3 | 21.3 | 12.3 | 2.0 | 14.9 | 0.8 | 18.0 | 2.6 | 1.0 | 12.0 |
| 12 | 1.39 | 0.78 | 0.59 | 23.5 | 35.5 | 20.0 | 2.0 | 25.5 | 1.0 | 20.2 | 4.0 | 1.6 | 21.0 |
| 13 | 1.41 | 0.83 | 0.71 | 16.4 | 26.0 | 15.3 | 2.0 | 18.4 | 1.0 | 17.8 | 4.0 | 1.6 | 18.5 |

TABLE 2

Fillings of experimental lamps

| Lamp | Hg dose (mg) | Ar fill pressure (mbar) | Salt dose (mg) | Salt composition (mol %) |
|---|---|---|---|---|
| 1 | 43 | 400 | 30 | NaI 23.9/TlI 2.9/$CaI_2$ 71.8/$CeI_3$ 1.3 |
| 2 | 18 | 400 | 30 | NaI 4.3/TlI 1.2/$CaI_2$ 90.5/$CeI_3$ 3.2/InI 0.9 |
| 3 | 18 | 400 | 30 | NaI 4.3/TlI 1.2/$CaI_2$ 88.2/$CeI_3$ 3.2/ $MnI_2$ 3.2 |
| 4 | 18 | 100 | 16 | NaI 23.9/TlI 2.9/$CaI_2$ 71.8/$CeI_3$ 1.3 |
| 5 | 17 | 100 | 16 | NaI 4.3/TlI 1.2/$CaI_2$ 90.5/$CeI_3$ 3.2/InI 0.9 |
| 6 | 13 | 100 | 16 | NaI 23.9/TlI 2.9/$CaI_2$ 71.8/$CeI_3$ 1.3 |
| 7 | 12 | 100 | 16 | NaI 4.3/TlI 1.2/$CaI_2$ 90.5/$CeI_3$ 3.2/InI 0.9 |
| 8 | 16 | 400 | 30 | NaI 23.9/TlI 2.9/$CaI_2$ 71.8/$CeI_3$ 1.3 |
| 9 | 42 | 400 | 30 | NaI 23.9/TlI 2.9/$CaI_2$ 71.8/$CeI_3$ 1.3 |
| 10 | 60 | 400 | 30 | NaI 23.9/TlI 2.9/$CaI_2$ 71.8/$CeI_3$ 1.3 |
| 11 | 17 | 100 | 17 | NaI 10.5/TlI 1.1/$CaI_2$ 81.3/ $CeI_3$ 1.9/InI 0.8/$MnI_2$ 4.4 |
| 12 | 52 | 400 | 50 | NaI 23.9/TlI 2.9/$CaI_2$ 71.8/$CeI_3$ 1.3 |
| 13 | 36 | 400 | 30 | NaI 23.9/TlI 2.9/$CaI_2$ 71.8/$CeI_3$ 1.3 |

TABLE 3

Results of experimental lamps

| Lamp | Wattage (W) | Lumen output (lm) | Efficacy (lm/W) | CCT (K) | CRI | failures |
|---|---|---|---|---|---|---|
| 1 | 320 | 39216 | 123 | 3022 | 90 | no |
| 2 | 320 | 38137 | 119 | 4230 | 88 | no |
| 3 | 320 | 37242 | 116 | 4305 | 91 | no |
| 4 | 210 | 24696 | 118 | 3133 | 91 | no |
| 5 | 210 | 23809 | 113 | 4052 | 85 | no |
| 6 | 143 | 16698 | 117 | 3001 | 90 | no |
| 7 | 143 | 16409 | 115 | 4560 | 86 | no |
| 8 | 320 | 38429 | 120 | 4263 | 76 | yes |
| 9 | 320 | 38174 | 119 | 3183 | 85 | yes |
| 10 | 320 | 35578 | 111 | 3253 | 88 | yes |
| 11 | 205 | 23741 | 116 | 3819 | 95 | no |
| 12 | 1000 | 125838 | 126 | 3673 | 90 | no |
| 13 | 320 | 39755 | 124 | 3115 | 90 | yes |

These data show that lamps 25 according to the invention with discharge vessels 1 as defined above, i.e. lamps 1-7, 11-12 have excellent properties, whereas discharge vessels 8, 9 and 10 not according to the invention show failures (cracks, etc.) or have a relatively low efficacy. Lamp 10 is similar to the lamp described in EP0841687 (SP about 0.5). All lamps according to the inventions have a R9 of 60 or more.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A metal halide lamp (25) comprising a ceramic discharge vessel (1), wherein the discharge vessel (1) has a wall (30) enclosing a discharge space (22) with an ionizable filling, the discharge space (22) further enclosing electrodes (4,5) having electrode tips (4*b*,5*b*) arranged opposite each other and arranged to define a discharge arc between the electrode tips (4*b*,5*b*) during operation of the lamp (25), the discharge vessel (1) having a spheroid-like shape with a major axis (60) and a length L1, a largest inner diameter d1 and a largest outer diameter d2 and further having curved extremities (114,115), each having a curvature with radius r3 and a center of curvature located within the discharge space (22), wherein an aspect ratio L1/d2 is $1.1 \leqq L1/d2 \leqq 2.2$ and a first shape parameter r3/d2 is $0.7 \leqq r3/d2 \leqq 1.1$ wherein the major axis is substantially parallel to a line formed between said electrode tips.

2. The metal halide lamp (25) according to claim 1, wherein the electrode tips (4*b*,5*b*) are arranged at a distance L3 of each other, and $0.4 \leqq L3/L1 \leqq 0.7$.

3. The metal halide lamp (25) according to claim 1, wherein the shape parameter is $0.75 \leqq r3/d2 \leqq 0.9$.

4. The metal halide lamp (25) according to claim 1, wherein the aspect ratio is $1.3 \leqq L1/d2 \leqq 1.7$.

5. The metal halide lamp (25) according to claim 1, wherein the discharge vessel (1) has a wall thickness (w1) in the range of 0.5 to 2 mm.

6. The metal halide lamp (25) according to claim 1, wherein the rated power is at least 150 W.

7. The metal halide lamp (25) according to claim 1, wherein the discharge vessel (1) further comprises protruding end plugs (34,35) which surround at least part of the electrodes (4,5).

8. A metal halide lamp (25) comprising a ceramic discharge vessel (1), wherein the discharge vessel (1) has a wall (30) enclosing a discharge space (22) with an ionizable filling, the discharge space (22) further enclosing electrodes (4,5) having electrode tips (4*b*,5*b*) arranged opposite each other and arranged to define a discharge arc between the electrode tips (4*b*,5*b*) during operation of the lamp (25), the discharge vessel (1) having a spheroid-like shape with a major axis (60) and a length L1, a largest inner diameter d1 and a largest outer diameter d2 and further having curved extremities (114,115) with a curvature with radius r3, wherein an aspect ratio L1/d2 is $1.1 \leqq L1/d2 \leqq 2.2$ and a first shape parameter r3/d2 is $0.7 \leqq r3/d2 \leqq 1.1$;

wherein the ionizable filling comprises NaI, TlI, $CaI_2$ and X-iodide, and wherein X is selected from the group consisting of: rare-earth metals, scandium, and yttrium.

9. The metal halide lamp (25) according to claim 8, wherein X is selected from the group consisting of: Sc, Y, La, Ce, Pr, Gd, Tb, Dy, Ho, Er, Tm, Yb, Lu, and Nd.

10. The metal halide lamp (25) according to claim 8, wherein the group from which X is selected further consists of Ce, Pr, and Nd.

11. The metal halide lamp (25) according to claim 8, wherein the ionizable filling further comprises one or more halides selected from the group consisting of: Mn and In.

12. The metal halide lamp (25) according to claim 8, wherein the molar percentage ratio X-iodide/(NaI+TlI+$CaI_2$+X-iodide) is in the range of 0 to 10%.

13. The metal halide lamp (25) according to claim 8, wherein the molar percentage ratio $CaI_2$/(NaI+TlI+$CaI_2$+X-iodide) is in the range of 10 to 95%.

14. The metal halide lamp (25) according to claim 8, wherein the amount of NaI, TlI, $CaI_2$ and X-iodide in the discharge vessel (1) is in the range of 0.001 to 0.5 g/$cm^3$.

15. The metal halide lamp (25) according to claim 8, having an efficacy of at least 115 lm/W during operation.

16. The metal halide lamp (25) according to claim 8, emitting light during operation at a correlated color temperature CCT above 3500 K, wherein the filling of the discharge space also comprises an element selected from the group consisting of Mn, In and a combination thereof.

17. The metal halide lamp (25) according to claim 8, wherein the lamp has a wall load of 18 to 30 W/$cm^2$.

18. A metal halide lamp (25) comprising a ceramic discharge vessel (1), wherein the discharge vessel (1) has a wall (30) enclosing a discharge space (22) with an ionizable filling, the discharge space (22) further enclosing electrodes (4,5) having electrode tips (4*b*,5*b*) arranged opposite each other and arranged to define a discharge arc between the electrode tips (4*b*,5*b*) during operation of the lamp (25), the discharge vessel (1) having a spheroid-like shape with a major axis (60) and a length L1, a largest inner diameter d1 and a largest outer diameter d2 and further having four curved extremities (114,115), each having a separate center of curvature located within the discharge space, and each having a radius r3, wherein an aspect ratio L1/d2 is $1.1 \leqq L1/d2 \leqq 2.2$ and a first shape parameter r3/d2 is $0.7 \leqq r3/d2 \leqq 1.1$.

* * * * *